US009346176B2

(12) United States Patent
Collins et al.

(10) Patent No.: US 9,346,176 B2
(45) Date of Patent: May 24, 2016

(54) SPRING-ASSISTED FOLDING KNIFE

(71) Applicant: Jane Collins, North, SC (US)

(72) Inventors: Michael C. Collins, Blanchard, OK (US); Walter W. Collins, North, SC (US)

( * ) Notice: Subject to any disclaimer, the term of this patent is extended or adjusted under 35 U.S.C. 154(b) by 206 days.

(21) Appl. No.: 14/149,408

(22) Filed: Jan. 7, 2014

(65) Prior Publication Data

US 2014/0115898 A1 May 1, 2014

Related U.S. Application Data

(63) Continuation-in-part of application No. 13/442,116, filed on Apr. 9, 2012, now Pat. No. 8,752,298.

(51) Int. Cl.
*B26B 1/04* (2006.01)

(52) U.S. Cl.
CPC ..... *B26B 1/044* (2013.01); *B26B 1/048* (2013.01)

(58) Field of Classification Search
CPC ..... B26B 1/044; B26B 1/048
See application file for complete search history.

(56) References Cited

U.S. PATENT DOCUMENTS 4,451,982 A * 6/1984 Collins ..... B26B 1/048 30/157
5,111,581 A 5/1992 Collins
5,325,588 A 7/1994 Rogers
5,769,094 A 6/1998 Jenkins, Jr. et al.
5,822,866 A 10/1998 Pardue
6,079,106 A 6/2000 Vallotton
6,256,888 B1 7/2001 Shuen
6,684,510 B1 * 2/2004 Collins ..... B26B 1/048 30/155
6,941,661 B2 9/2005 Frazer
7,032,315 B1 * 4/2006 Busse ..... B26B 1/048 30/153
7,243,430 B1 7/2007 Lerch
7,246,441 B1 7/2007 Collins
7,941,927 B1 * 5/2011 Demko ..... B26B 1/048 30/157
8,099,870 B1 1/2012 Ralph
8,499,460 B1 8/2013 Pearman
8,752,298 B2 * 6/2014 Collins ..... B26B 1/044 30/160
2001/0016987 A1 * 8/2001 Chen ..... B26B 1/048 30/161
2003/0070299 A1 4/2003 Frazer
2006/0026844 A1 * 2/2006 Ping ..... B26B 1/046 30/153
2013/0133205 A1 * 5/2013 Lo ..... B26B 1/048 30/160
2014/0115898 A1 * 5/2014 Collins ..... B26B 1/044 30/159

* cited by examiner

*Primary Examiner* — Hwei C Payer
(74) *Attorney, Agent, or Firm* — Harris Beach PLLC

(57) ABSTRACT

A method of operating a spring assisted folding knife includes the steps of: providing a spring assisted folding knife including a handle, a blade, a transfer bar assembly contained in a transfer bar assembly recess, a helical spring, and a coiled torsion spring; and pivotally moving the blade to overcome a blade closed bias force provided by the helical spring pressing against the transfer bar assembly followed by a blade opened bias provided by the coiled torsion spring, or to overcome a blade opened bias provided by the coiled torsion spring followed by a blade closed bias force provided by the helical spring pressing against the transfer bar assembly.

19 Claims, 16 Drawing Sheets

SPRING-ASSISTED FOLDING KNIFE

CROSS-REFERENCE TO RELATED APPLICATIONS

This application is a continuation-in-part of U.S. patent application Ser. No. 13/442,116, now U.S. Pat. No. 8,752,298, SPRING-ASSISTED FOLDING KNIFE, filed Apr. 9, 2012, which application is incorporated herein by reference in its entirety.

FIELD OF THE INVENTION

This invention relates generally to the field of folding knives and more particularly to a method of operation a folding knife with a spring driven opening mechanism.

BACKGROUND OF THE INVENTION

Folding knives are popular due to their compact size and portability. However, a potential drawback of certain folding knives is that they require two hands for use. One hand is required for holding the handle portion of the blade, while the other hand is necessary to withdraw the blade from its retracted position within the handle and move the blade to the extended, operable position.

In most assisted-opening folding knives, a leaf torsion spring or straight wire spring is used, so that when the knife is opened, the spring provides an initial assist to move the blade, but the continued opening of the blade relies on inertia to complete the opening process.

For example, the folding knife disclosed in U.S. Pat. No. 5,815,927 (Collins) allows the user to extract the blade from its refracted position within the handle by the user's engaging and pulling on ridges defined in a rear portion of the blade. A plunger mechanism having a coil spring facilitates opening of the blade, but the user is still required to pull on the ridges in order to move the blade through a selected range of motion and for the spring to assist the blade to move it to the extended position.

Many folding knives have been patented. U.S. Pat. No. 273,858 (Korn) discloses a folding knife having a leaf-type spring for moving a blade to an extended position. U.S. Pat. No. 1,603,914 (Hermann) discloses a folding knife having a coil spring connected to a metal tape, which pulls the blade to a retracted position. U.S. Pat. No. 2,601,999 (Sly) discloses a foldable gaff hook having a similar opening mechanism. U.S. Pat. No. 2,407,897 (Newman) discloses a spring for pivoting blade open upon actuation of a locking lever. U.S. Pat. No. 698,080 (Treas) discloses use of an actuating spring for pivoting a blade to an open position. U.S. Pat. No. 4,535,539 (Friedman, et al.) and U.S. Pat. No. 5,093,995 (Jan) disclose button release mechanisms for folding knives. U.S. Pat. No. 4,893,409 (Poehlmann) and U.S. Pat. No. 5,964,035 (Poehlmann) disclose folding knives having adjustment screws for adjusting the fit of the blade in the extended position. U.S. Pat. No. 1,065,863 (Carter) also discloses use of set, or an adjustment, screw. U.S. Pat. No. 6,397,477 (Collins) discloses a spring-assisted folding knife which initiates pivoting a blade from a retracted position to a locked extended position. These knives typically use either inertia, gravity-assist, or a flick of the wrist to complete the opening process.

SUMMARY OF THE INVENTION

According to one aspect, a method of operating a spring assisted folding knife includes the steps of: providing a spring assisted folding knife including a handle, a blade, a transfer bar assembly contained in a transfer bar assembly recess, a helical spring, and a coiled torsion spring; and pivotally moving the blade to overcome a blade closed bias force provided by the helical spring pressing against the transfer bar assembly followed by a blade opened bias provided by the coiled torsion spring, or to overcome a blade opened bias provided by the coiled torsion spring followed by a blade closed bias force provided by the helical spring pressing against the transfer bar assembly.

In one embodiment, the step of pivotally moving the blade includes opening the blade from a blade closed position of the spring assisted folding knife by overcoming a closing bias force biased towards a closed blade provided by the transfer bar assembly wherein as the blade is removed from the handle, the closing bias force first increases as the helical spring is compressed by the transfer bar assembly, then the closing bias eases as a front section of the transfer assembly rotates past a sear of a blade tang of the blade and a mechanical force biasing the blade to an open position provided by the torsion spring becomes dominant, the torsion spring having been previously pre-tensioned in the blade closed position, and then reaching a blade open position.

In another embodiment, the method further includes the step of compressing partially the helical spring on opening the blade from a closed position to an opening angle of less than about 10° by the blade tang causing the transfer bar assembly to move in a compression direction towards the helical spring.

In yet another embodiment, the method further includes the step of moving partially a longitudinal axis of the front section away from a longitudinal axis of a rear section of the transfer bar assembly on further opening the blade to an opening angle of less than about 30° by the blade tang and causing tensioning of a leaf spring and partially un-tensioning the coiled torsion spring.

In yet another embodiment, the method further includes the step of moving further a longitudinal axis of the front section away from a longitudinal axis of a rear section of the transfer bar assembly on opening the blade from the closed position to an opening angle of less than about 90° by the blade tang substantially releasing axial pressure by the helical spring on the rear section of the transfer bar assembly and causing further tensioning of a leaf spring and un-tensioning the coiled torsion spring.

In yet another embodiment, the method further includes the step of continuing to un-tension the coiled torsion spring as the blade moves further towards a blade fully opened position.

In yet another embodiment, the method further includes the step of stopping a stop surface of the blade tang against a spine stop in a blade fully opened position.

In yet another embodiment, the method further includes the step of locking the blade into an opened position by a liner lock moving behind a flat surface of the blade tang.

In yet another embodiment, the step of pivotally moving the blade includes closing the blade to a blade closed position from a blade open position by overcoming an opening bias force biased towards an open blade provided by the torsion spring and wherein as the blade is moved towards the handle, the closing bias force first increases as a front section of the transfer assembly engages a sear of a blade tang of the blade and the helical spring is compressed by the transfer bar assembly, then eases as the blade enters the closed position with a dominant closing force bias against opening provided by the transfer assembly and the helical spring.

In yet another embodiment, the method further includes the step of un-locking the blade from an opened locked position by a depressing a liner lock moving the liner lock from behind a flat surface of the blade tang.

In yet another embodiment, the method further includes the step of moving a stop surface of the blade tang away from a spine stop as the blade rotates from a blade fully opened position.

In yet another embodiment, the method further includes the step tensioning the coiled torsion spring as the blade moves further from a blade fully opened position.

In yet another embodiment, the method further includes the step moving a longitudinal axis of the front section towards a longitudinal axis of a rear section of the transfer bar assembly on closing the blade from an opened position to a closing angle of less than about 90° by the blade tang substantially engaging an axial pressure on the helical spring on the rear section of the transfer bar assembly and causing an un-tensioning of a leaf spring and a tensioning the coiled torsion spring.

In yet another embodiment, the method further includes the step of moving partially a longitudinal axis of the front section towards a longitudinal axis of a rear section of the transfer bar assembly on further closing of the blade to an closing angle of less than about 30° by the blade tang and causing an un-tensioning of a leaf spring and further tensioning the coiled torsion spring.

In yet another embodiment, the method further includes the step of compressing the helical spring on closing the blade from a partially opened position to a closing angle of less than about 10° by the blade tang causing the transfer bar assembly to move in a compression direction towards the helical spring.

In yet another embodiment, the method further includes the step of closing the blade in the handle.

In yet another embodiment, the step of opening the blade of the spring assisted folding knife further includes after a blade opened position a step of locking the blade in an open position by engaging a liner lock against a second rear flat vertical surface of a blade tang.

In yet another embodiment, the step of opening the blade further includes grasping a thumb stud.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION

Figure 1:
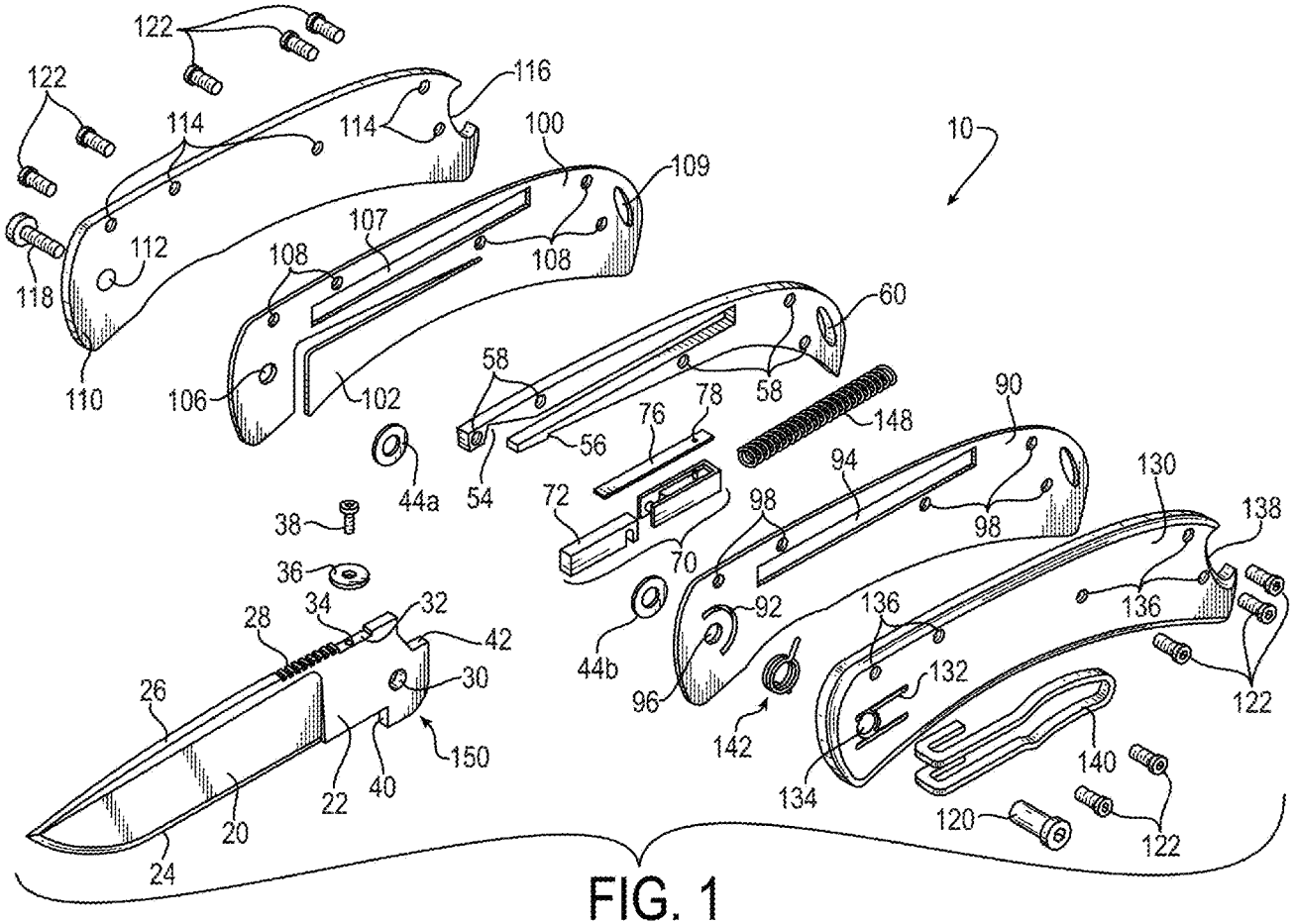
FIG. 1 shows an exploded perspective view of a folding knife according to an embodiment of the invention.
Figure 2:
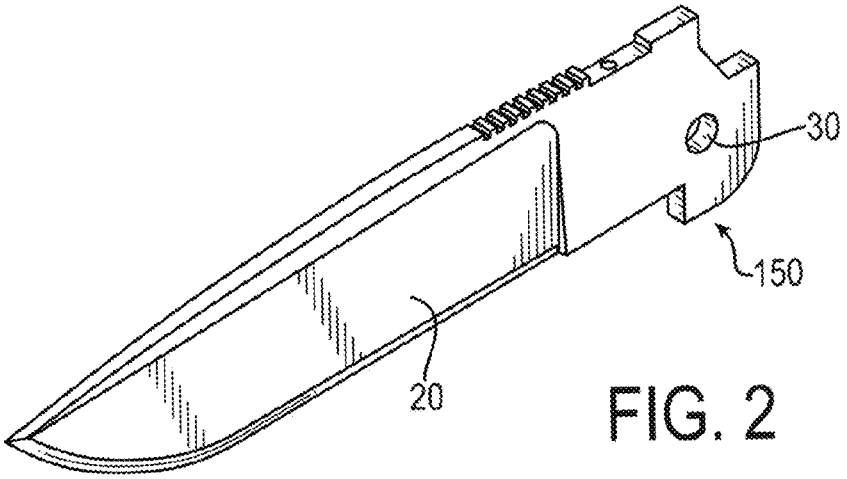
FIG. 2 shows a perspective view of a lock blade according to an embodiment of the invention.

Referring to FIG. 1, a folding knife 10 is shown in its component parts. Referring also to FIG. 2, a lock blade 20, preferably made of 420HC stainless and preferably heat treated to 50-59 HRC, includes an edge 24, a blade spine 26 with a notched area 28 on it, and a tang 22. Blade spine 26 preferably includes a recessed area 32 with a threaded hole 34 centered therein which receives a thumb stud screw 38 which attaches a thumb stud 36 to lock blade 20. Tang 22 includes a hole 30 and a hole 150 which are used in the knife assembly process, a sear 40, and a cutout area 42. Cutout area 42 ensures that lock blade 20 doesn't interfere with the remainder of the knife as it is folded. The purpose of sear 40 will be explained later.

Figure 3:
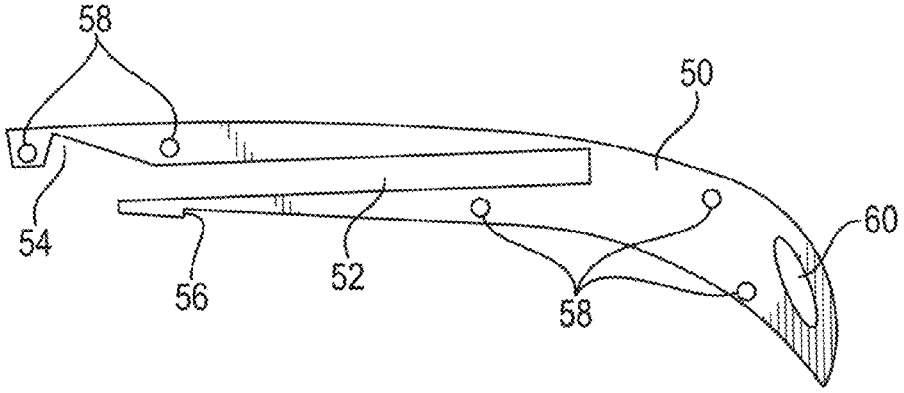
FIG. 3 shows a front elevation view of a spine according to an embodiment of the invention.
Figure 4A:
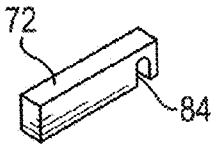
FIG. 4A shows a perspective view of a front transfer bar according to an embodiment of the invention.
Figure 4B:
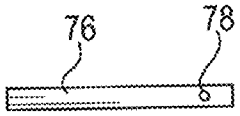
FIG. 4B shows a top view of a leaf spring according to an embodiment of the invention.
Figure 4C:
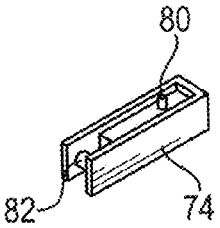
FIG. 4C shows a perspective view of a rear transfer bar according to an embodiment of the invention.
Figure 4D:
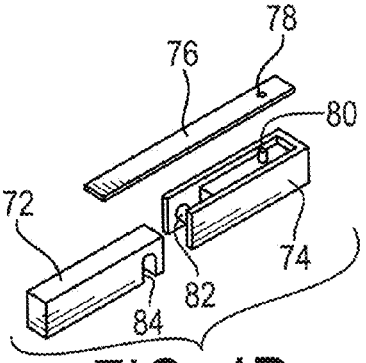
FIG. 4D shows a perspective exploded view of the front transfer bar, rear transfer bar, and leaf spring according to an embodiment of the invention.
Figure 4E:
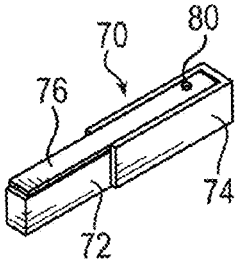
FIG. 4E shows a perspective view of a transfer bar assembly according to an embodiment of the invention.

Referring now to FIGS. 1 and 3, a spine 50 is preferably of 420 stainless and includes a transfer bar assembly recess 52 for receiving a transfer bar assembly 70, a recess 54, a liner lock stop 56, a plurality of threaded holes 58, and a lanyard hole 60.

Referring to FIGS. 1 and 4, transfer bar assembly 70 includes a front transfer bar 72 which includes a hook 84, while a rear transfer bar 74 includes a bar 82. Hook 84 fits over bar 82, thus connecting front transfer bar 72 to rear transfer bar 74 while allowing front transfer bar 72 to pivot with respect to rear transfer bar 74. A leaf spring 76 is connected across front transfer bar 72 and rear transfer bar 74 to keep transfer bar assembly 70 biased in the straight position. Leaf spring 76 is preferably made of stainless steel, while front transfer bar 72 is preferably made of high carbon stainless steel, so leaf spring 76 can be welded to front transfer bar 72. Rear transfer bar 74 is preferably made of a plastic such as DELRIN®, so a stud hole 78 is formed near an end of leaf spring 76 which fits over a stud 80 on rear transfer bar 74. Leaf spring 76 is then connected to rear transfer bar 74 preferably by hot melting stud 80.

Figure 5:
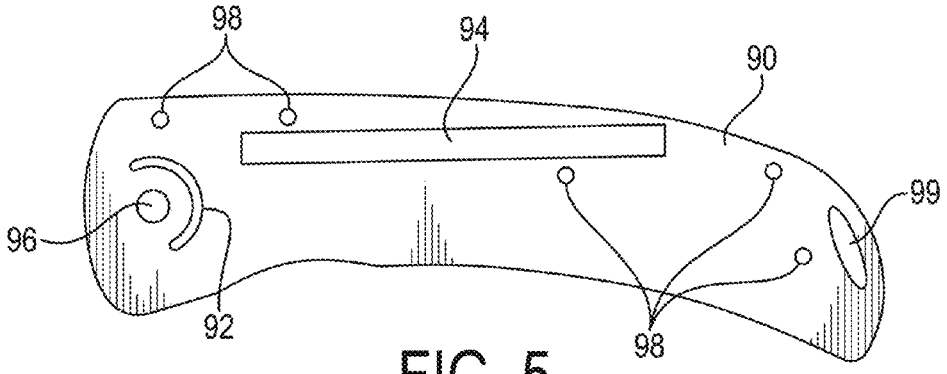
FIG. 5 shows a front elevation view of a mark side liner according to an embodiment of the invention.

Referring to FIGS. 1 and 5, a mark side liner 90 includes a curved slot 92 and a transfer bar assembly recess 94. Mark side liner also includes a hole 96, a plurality of threaded holes 98, and a lanyard hole 99.

Figure 6:
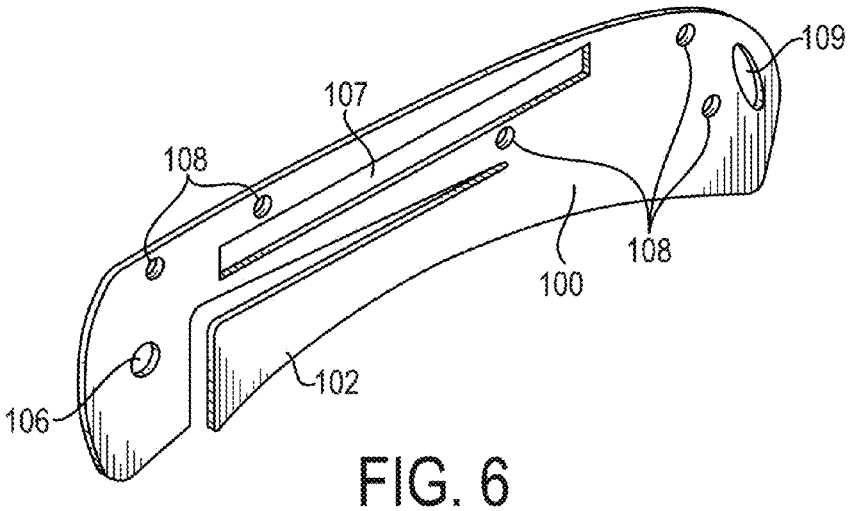
FIG. 6 shows a perspective view of a liner lock according to an embodiment of the invention.

Referring to FIGS. 1 and 6, a lock side liner 100 includes a transfer bar assembly recess 107 and a liner lock 102. Lock side liner 100 also includes a hole 106, a plurality of threaded holes 108, and a lanyard hole 109.

Figure 7A:
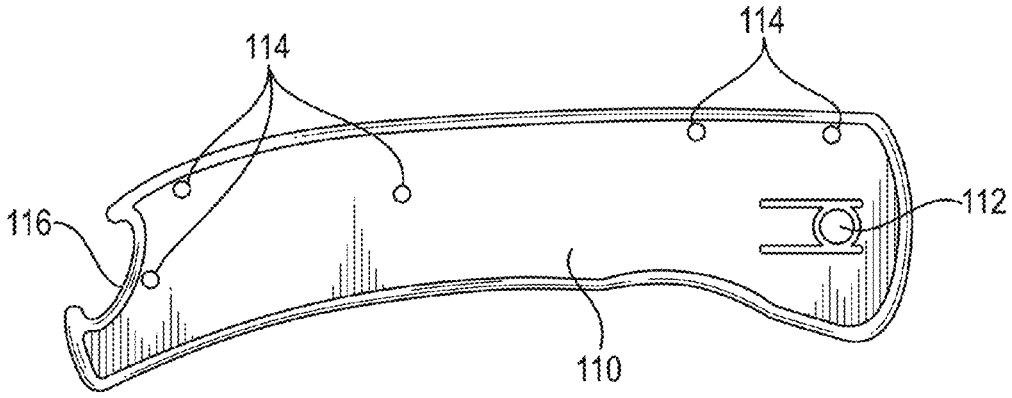
FIG. 7A shows a front elevation view, including stippling, of a file side handle according to an embodiment of the invention.
Figure 7B:
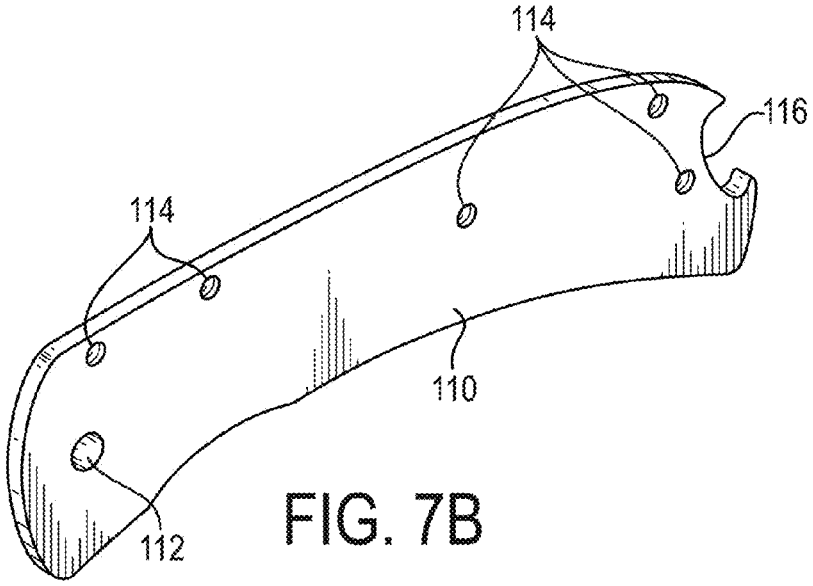
FIG. 7B shows a perspective view of the file side handle of FIG. 7A.

Referring to FIGS. 1 and 7, a file side handle 110 includes a hole 112, a plurality of threaded holes 114, and a lanyard notch 116.

Figure 8A:
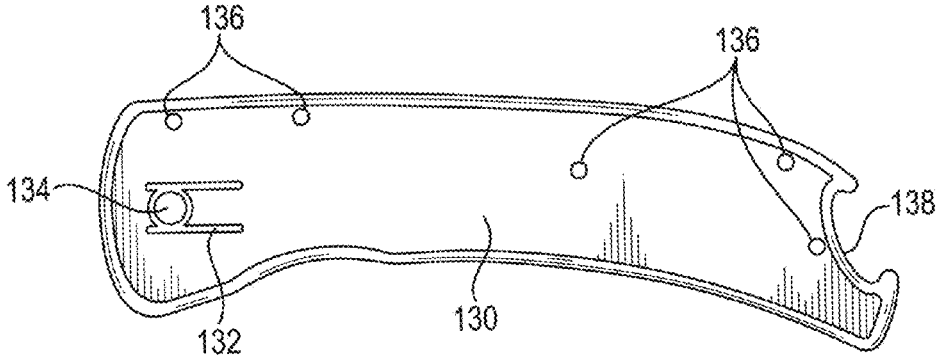
FIG. 8A shows a front elevation view, including stippling, of a mark side handle according to an embodiment of the invention.
Figure 8B:
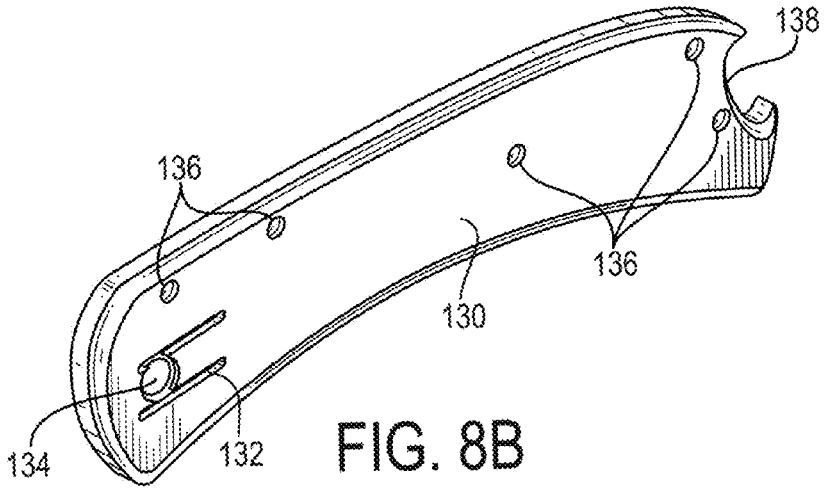
FIG. 8B shows a perspective view of the mark side handle of FIG. 8A.

Referring to FIGS. 1 and 8, a mark side handle 130 includes a hole 134, a plurality of threaded holes 136, a lanyard notch 138, and a belt clip recess 132.

Figure 9A:
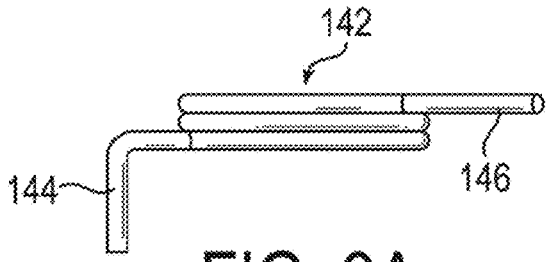
FIG. 9A shows a front elevation view of a blade opener spring according to an embodiment of the invention.
Figure 9B:
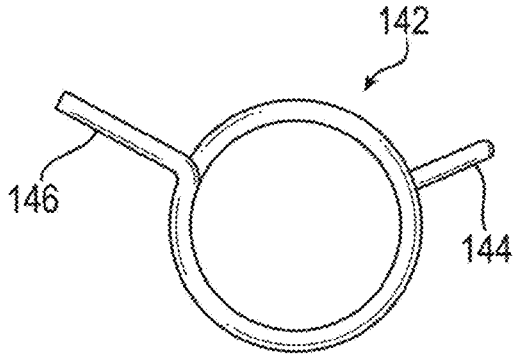
FIG. 9B shows a top view of the blade opener spring of FIG. 9A.
Figure 9C:
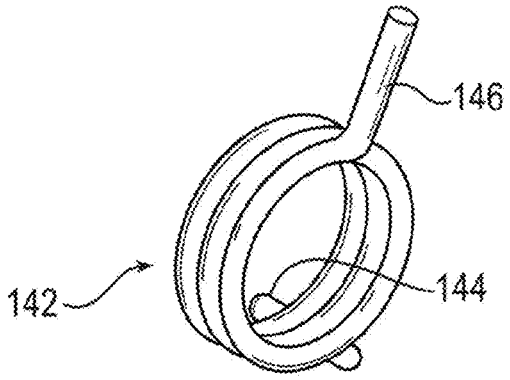
FIG. 9C shows a perspective view of the blade opener spring of FIGS. 9A-9B.

Referring to FIGS. 1 and 9, a blade opener spring 142 is shown, with an end 144 bent orthogonally to a plane running through a circumference of a circular portion of spring 142, and another end 146 bent outward along a radial axis of the circular portion of spring 142. Blade opener spring 142 is a torsion coiled spring, preferably of 0.025 inch diameter music wire.

Figure 10:
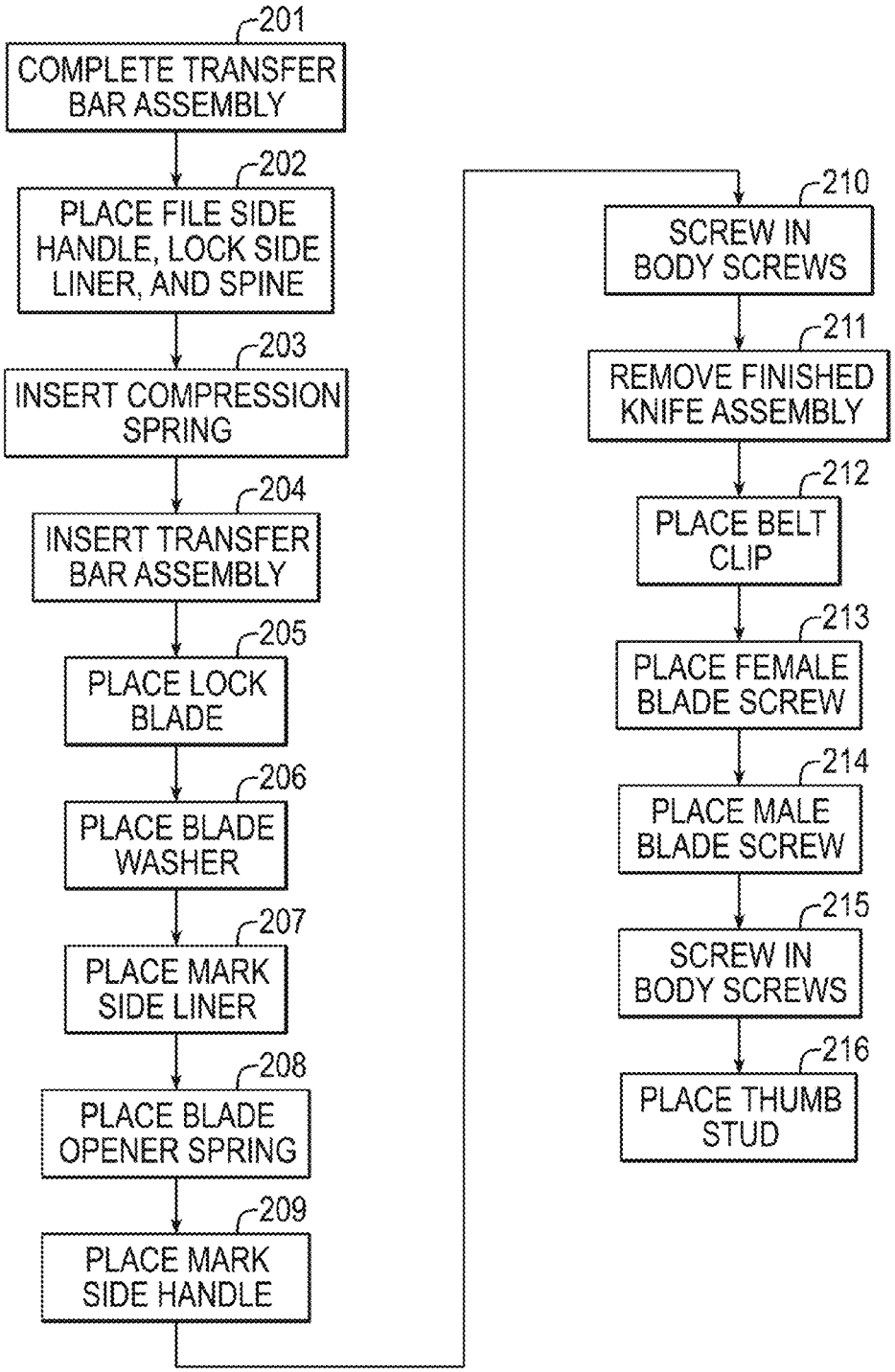
FIG. 10 shows a method of assembly of the folding knife of FIG. 1.

Referring to FIGS. 1 and 10, folding knife 10 is preferably assembled as follows. In step 201, transfer bar assembly 70 is completed by fitting front transfer bar 72 to rear transfer bar 74 by placing hook 84 over bar 82. Leaf spring 76 is placed onto stud 80 of rear transfer bar 74 (FIG. 4) a attached by hot melting stud 80 or riveting. In step 202, file side handle 110 is preferably placed in an assembly fixture (not shown) or held in a person's hand (not shown), after which lock side liner 100 is placed onto file side handle 110, followed by blade washer 44 *a* and spine 50. If using the assembly fixture, the assembly fixture contains a blade assembly guide pin which fits through holes 112, 106, and blade washer 44 *a*. If using one's hand, male blade screw 118 preferably forms this function.

In step 203, a compression spring 148 is inserted into transfer bar assembly recess 52 of spine 50, and in step 204, transfer bar assembly 70 is inserted in the front portion of spine 50 in front of compression spring 148. Compression spring 148 is thus to the rear of transfer bar assembly 70. "Rear" denotes the end of spine 50 which contains lanyard hole 60, while "front" denotes the opposite end.

In step 205, hole 30 of lock blade 20 is placed onto the blade assembly guide pin if using the assembly fixture, or alternatively onto the end of male blade screw 118. Folding knife 10 is preferably assembled with lock blade 20 in the open position. In step 206, blade washer 44 *b* is placed onto the blade assembly guide pin if using the assembly fixture, or alternatively onto the end of male blade screw 118.

In step 207, mark side liner 90 is emplaced onto the growing knife assembly. Then, in step 208, a blade opener spring 142 is placed onto the blade assembly guide pin if using the assembly fixture, or alternatively onto the end of male blade screw 118. End 144 must be placed through curved slot 92 into hole 150 of lock blade 20. In step 209, mark side handle 130 is placed onto mark side liner 90.

In step 210, body screws 122 are screwed into corresponding holes 136 on mark side handle 130. In step 211, the finished knife assembly is removed from the assembly fixture if one is being used. In step 212, belt clip 140 is placed into belt clip recess 132, after which female blade screw 120 is inserted into hole 134 in step 213. If the assembly fixture was used to assemble the knife, in step 214 male blade screw 118 is inserted into hole 112 and screwed into the end of female blade screw 120; but if no assembly fixture was used and male blade screw 118 is already within the knife assembly, at this step male blade screw 118 is simply screwed into female blade screw 120.

In step 215, body screws 122 are screwed into corresponding holes 114 in file side handle 110. Finally, in step 216, thumb stud 36 is fastened in place in recess area 32 using thumb stud screw 38.

Folding knife 10 is an assisted opening folding knife. When lock blade 20 is in the closed position, it is biased into the closed position by compression spring 148, with sear 40 engaging transfer bar assembly 70. When opening lock blade 20, once lock blade 20 is moved out approximately 30° and front transfer bar 72 clears sear 40, the action of blade opener spring 142 moves lock blade 20 into the fully open position.

The folding knife 10 as described hereinabove was also described in U.S. patent application Ser. No. 13/442,116, now U.S. Pat. No. 8,752,298, Spring-Assisted Folding Knife, filed Apr. 9, 2012, which application is incorporated herein by reference in its entirety for all purposes. In the description which follows, a method of operation for a folding knife similar to the exemplary folding knife 10 is described in more detail, with an emphasis on how the transfer bar assists in opening and closing the blade. FIG. 11A to FIG. 11G show another embodiment of the spring-assisted folding knife 12000 as described hereinabove with respect to folding knife 10. The parts are similar, but not identical, to the parts of folding knife 10 as illustrated in FIG. 1 to FIG. 10. New reference designators are assigned because some of the shapes of parts are not identical to the very similar parts of FIG. 1 to FIG. 10. However, to better assist the reader to understand the operation of the spring-assisted folding knife 12000 with regard to the description hereinabove, the last two digits "nn" or three digits "nnn" of the reference designators (e.g. 120 nn or 12 nnn) generally follow the reference designators of FIG. 1 and related drawings. FIG. 11A to FIG. 11G show in more detail the operation of the transfer assembly and related springs in more detail. The operation of each of these components is described in detail as the knife progresses by the novel spring assist technique from a closed stowed position to an opened position ready for use.

Figure 11A:
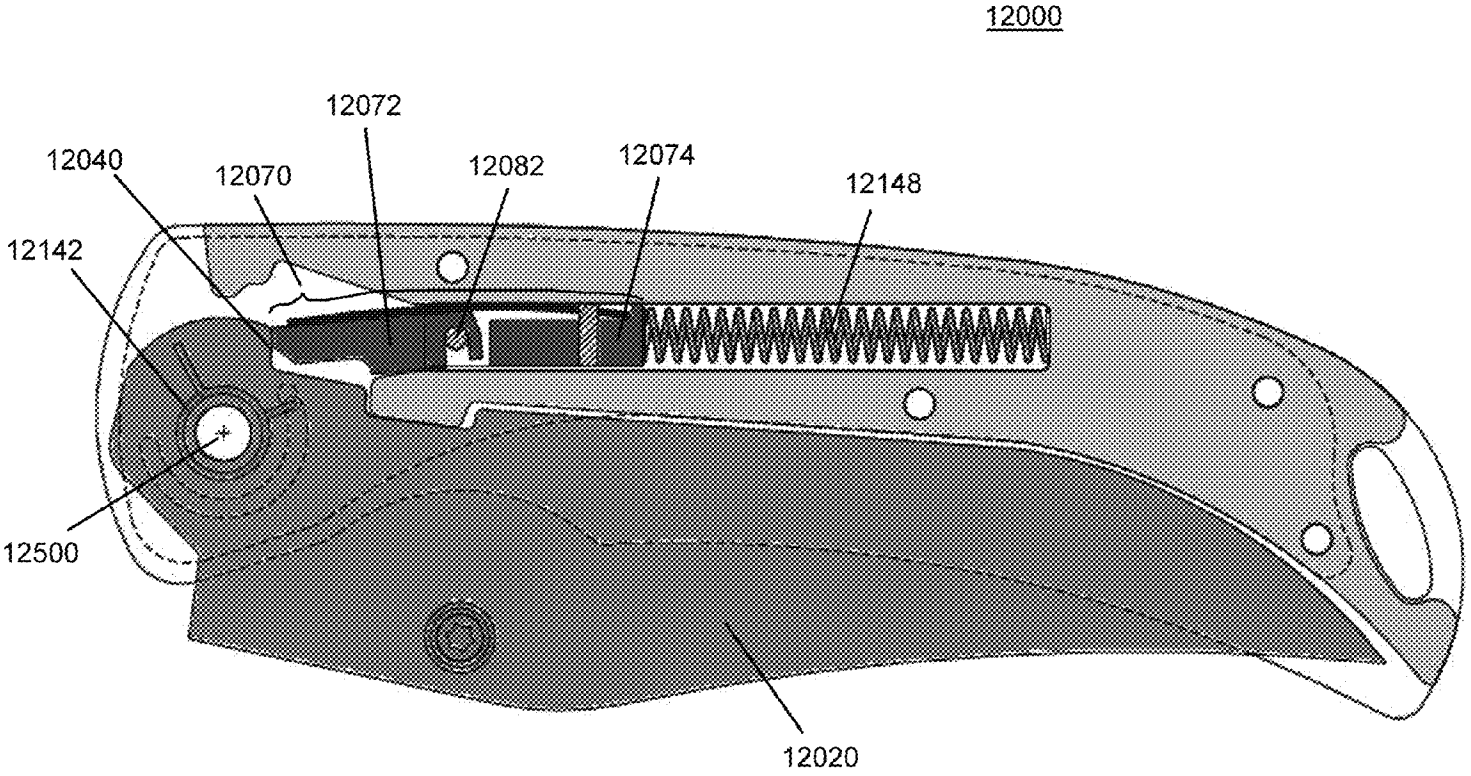
FIG. 11A shows another embodiment of an exemplary spring-assisted folding knife with the blade in the closed position.

FIG. 11A shows the exemplary spring-assisted folding knife 12000 with the blade 12020 in the closed knife blade stowed position. In the closed position, spring-assisted folding knife 12000 is biased closed. Blade 12020 is closed and is being held closed by pressure applied by the round compression spring 12148 (a helically wound compression spring). The round compression spring 12148 is applying an axial force against the rear section 12074 of the transfer bar assembly 12070. The rear section 12074 of the transfer bar assembly 12070 then applies an axial force against the front section 12072 of the transfer bar assembly 12070 which is pivotally connected by a hinge pin 12082 to the rear section 12074 of the transfer bar assembly 12070. The front section 12072 is capable of pivoting around the hinge pin 12082 to match the shape and position of the blade tang 12022. The front section is biased by a formed torsion spring 12142 which surrounds a rivet 12500 (similar to 120, 118, FIG. 1). In the closed and nearly closed positions of blade 12020, the blade is mechanically biased in or towards the blade closed position by the front section 12072 pushing against sear 12040 of blade tang 12022.

Figure 11B:
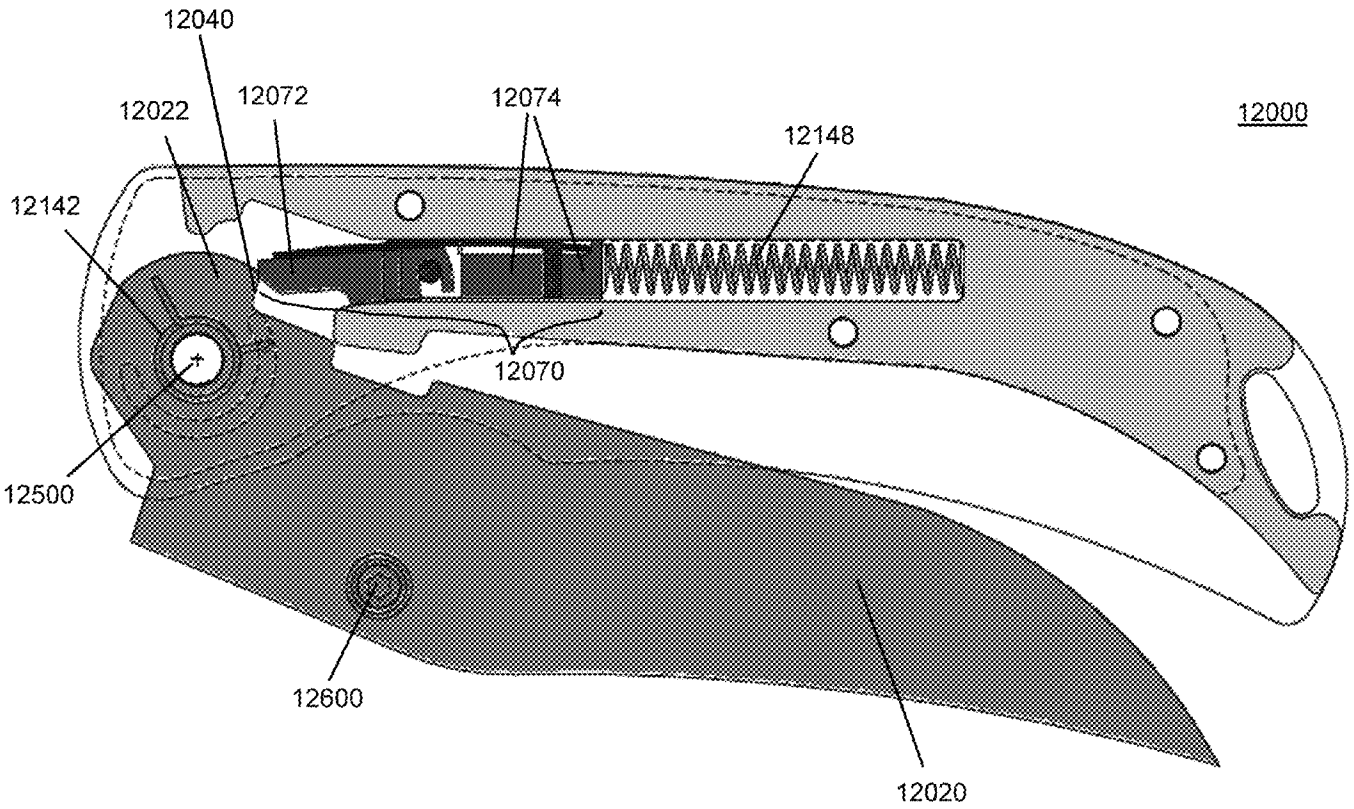
FIG. 11B shows the exemplary spring-assisted folding knife of claim 11A where the blade has been rotatingly opened to about 3° to 10° from the closed stowed position.

FIG. 11B shows the exemplary spring-assisted folding knife 12000 where blade 12020 has been rotatingly opened about the mechanical pivot point of rivet 12500 by about 3° to 10° from the closed stowed position of FIG. 11A. To rotatingly open blade 12020, angular pressure is applied to the blade (e.g. by grasping blade thumb stud 12600) by an operator (a user of the spring-assisted folding knife 12000). The blade tang 12022 then begins to rotate clockwise (CW). As the blade 12020 rotates from the closed stowed position of FIG. 11A, the blade tang 12022 applies pressure against the front vertical face of the front section 12072 of the transfer bar assembly 12070. The transfer bar assembly 12070 is forced backwards against the round compression spring 12148. Thus the blade 12020 by blade tang 12022 remains mechanically biased by the spring force of round compression spring 12148 towards the closed position.

Figure 11C:
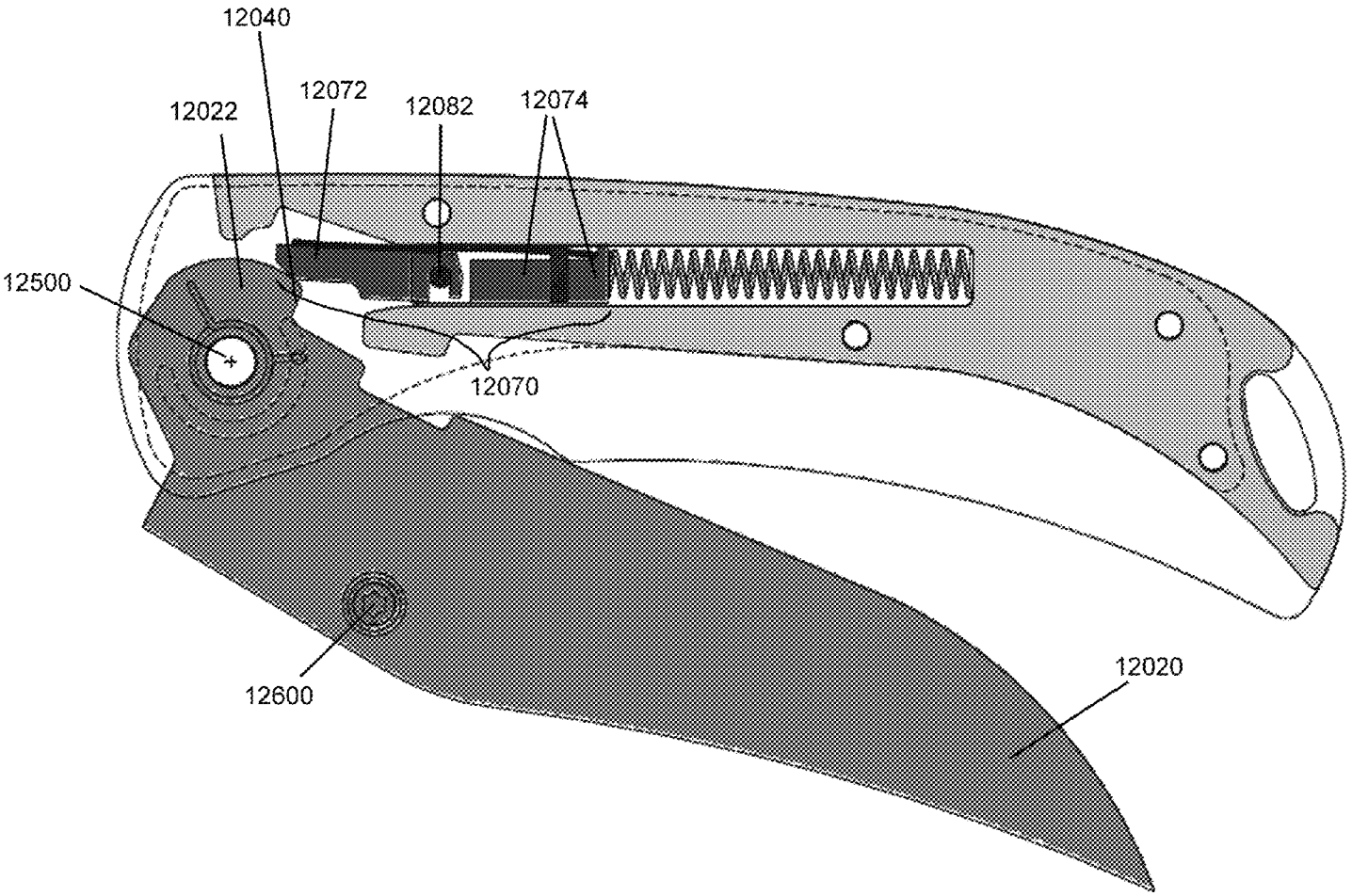
FIG. 11C shows the exemplary spring-assisted folding knife of claim 11A where the blade has been rotatingly opened to about 10° to 20° from the closed stowed position of FIG. 11A.

FIG. 11C shows the exemplary spring-assisted folding knife 12000 where blade 12020 has been rotatingly opened about the mechanical pivot point of rivet 12500 by about 10° to 20° from the closed stowed position of FIG. 11A. With pressure continuing to be applied by the user, such as by angular pressure is applied to the blade thumb stud 12600, the blade 12020 continues to rotate clockwise. As the corner of the blade tang 12022 rotates CW, blade tang 12022 slips away from (e.g. downward in FIG. 11C) and away from the front vertical face of the front section 12072 of the transfer bar assembly 12070. The axis of the front section 12072 of the transfer bar assembly 12070 slips away from the axis of the rear section 12074 (e.g. upwards in FIG. 11C) rotating CW around the hinge pin 12082, and is predominantly biased now towards the blade open position by the pre-tensioned coiled torsion spring 12142.

Figure 11D:
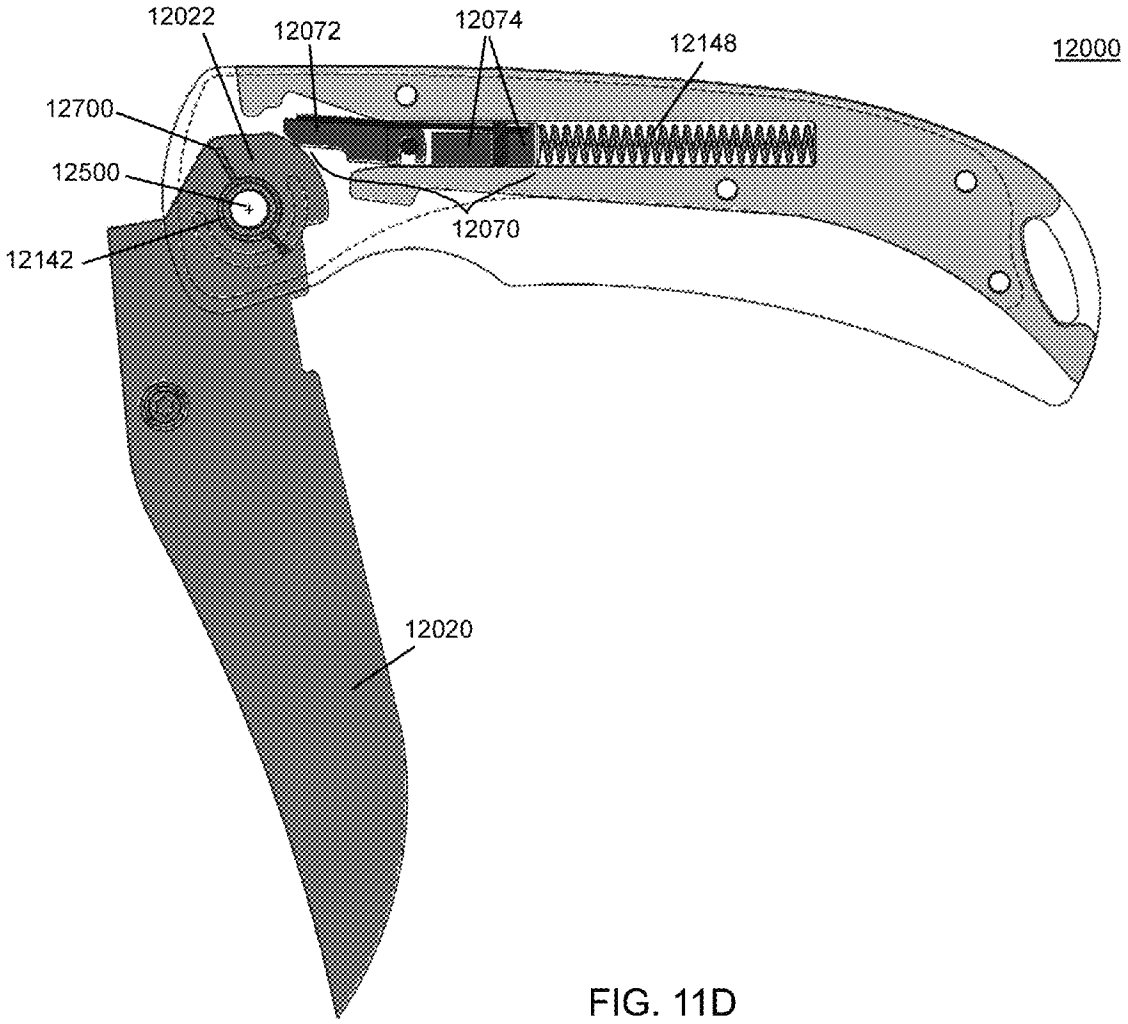
FIG. 11D shows the exemplary spring-assisted folding knife of claim 11A where the blade has been rotatingly opened about 70° to 80° from the closed stowed position.

FIG. 11D shows the exemplary spring-assisted folding knife 12000 where blade 12020 has been rotatingly opened about the mechanical pivot point of rivet 12500 by about 70° to 80° from the closed stowed position of FIG. 11A. As the front section 12072 of the transfer bar assembly 12070 rotates clockwise about hinge pin 12082, the axial pressure being applied by the round compression spring 12148 to the blade tang 12022 to hold the blade 12020 closed is removed. At this point, the continued clockwise rotation of the blade 12020 is taken over by the stored potential energy within the coiled torsion spring 12142. The coiled torsion spring 12142 has two legs, one is held stationary by the knife handle, the other is attached to the blade tang through a hole 12700 in the blade tang.

Figure 11E:
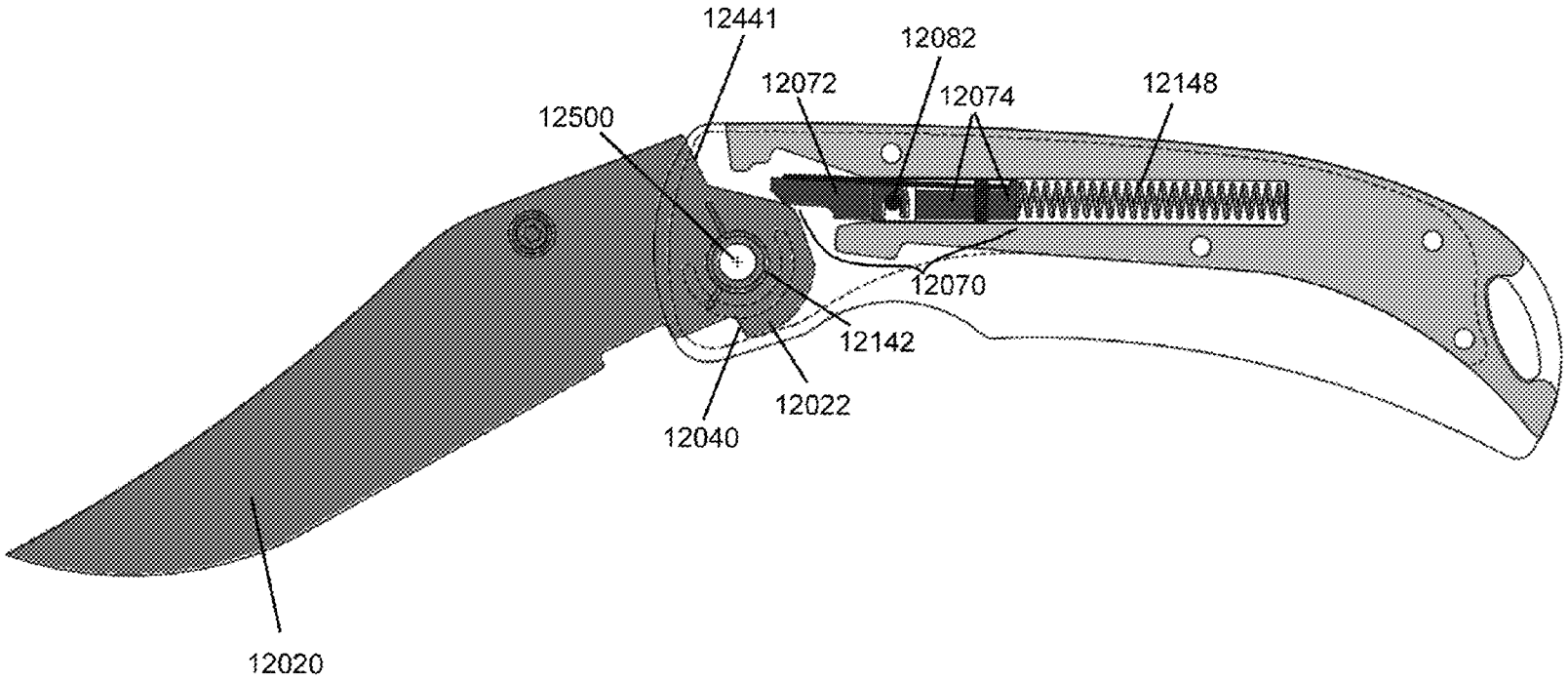
FIG. 11E shows the exemplary spring-assisted folding knife of claim 11A where the blade has been rotatingly opened to within about 15° to 30° from the fully open position.
Figure 11F:
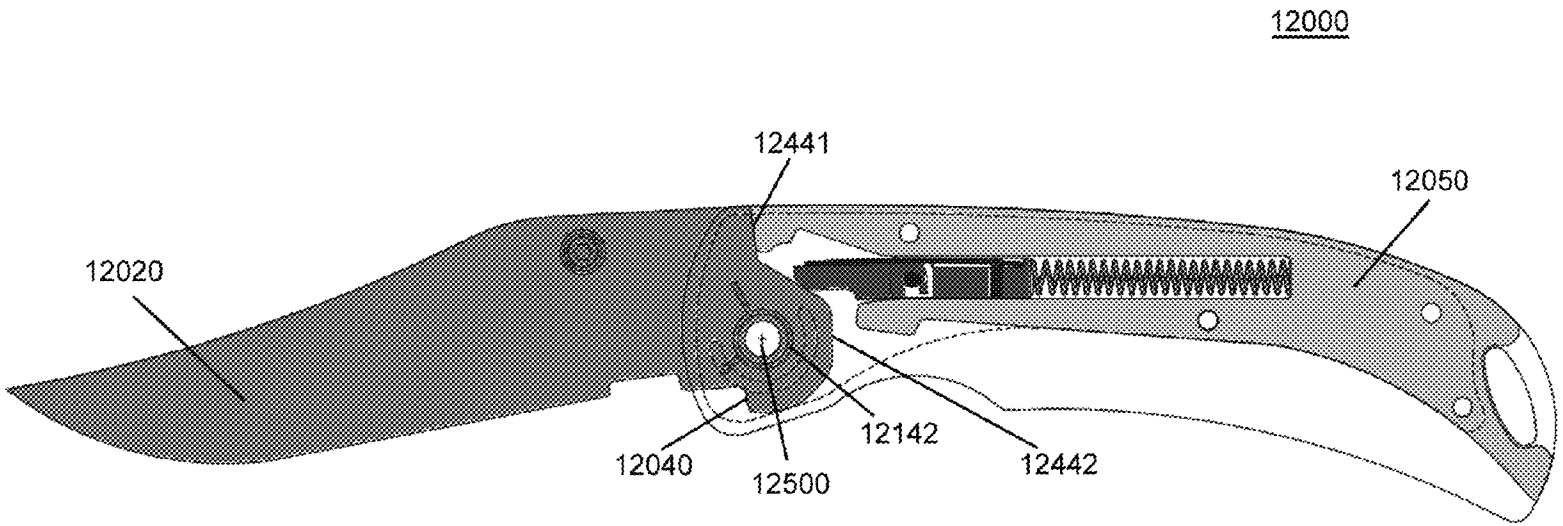
FIG. 11F shows the exemplary spring-assisted folding knife of claim 11A where the blade has been fully opened.

FIG. 11E shows the exemplary spring-assisted folding knife 12000 where blade 12020 has been rotatingly opened about the mechanical pivot point of rivet 12500 to within about 15° to 30° from the fully open position of FIG. 11F.

FIG. 11F shows the exemplary spring-assisted folding knife 12000 where blade 12020 has been rotatingly opened about the mechanical pivot point of rivet 12500. The blade 12020 is now in the fully open position and is at rest, biased by the spine 12050 and by the coiled torsion spring 12142. The first rear surface 12441 of the blade tang 12022 rests against an end surface of spine 12050.

Figure 11G:
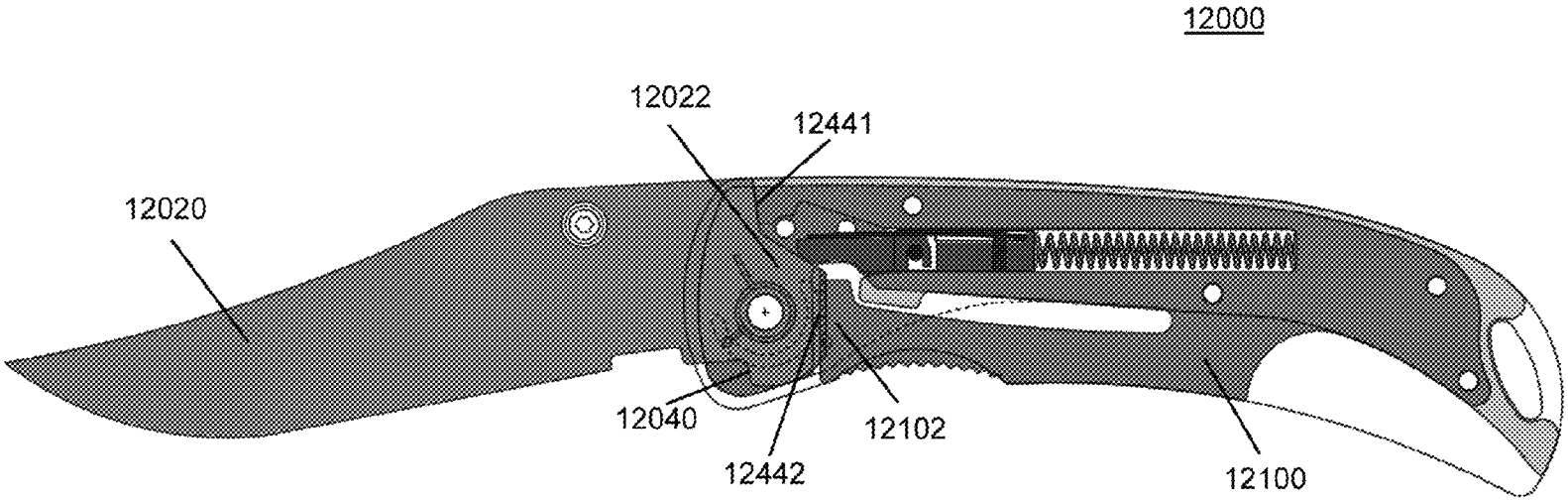
FIG. 11G shows another view of the exemplary spring-assisted folding knife of FIG. 11A where the blade has been fully opened and locked into the open position.

FIG. 11G shows another view of the exemplary spring-assisted folding knife 12000 where blade 12020 has been rotatingly opened about the mechanical pivot point of rivet 12500. The blade 12020 is shown held in the open position by a liner lock 12102 of lock side liner 12100, which applies stopping pressure against a second rear flat vertical surface 12442 of the blade tang 12022 and prevents the blade 12020 from inadvertently closing.

Figure 12:
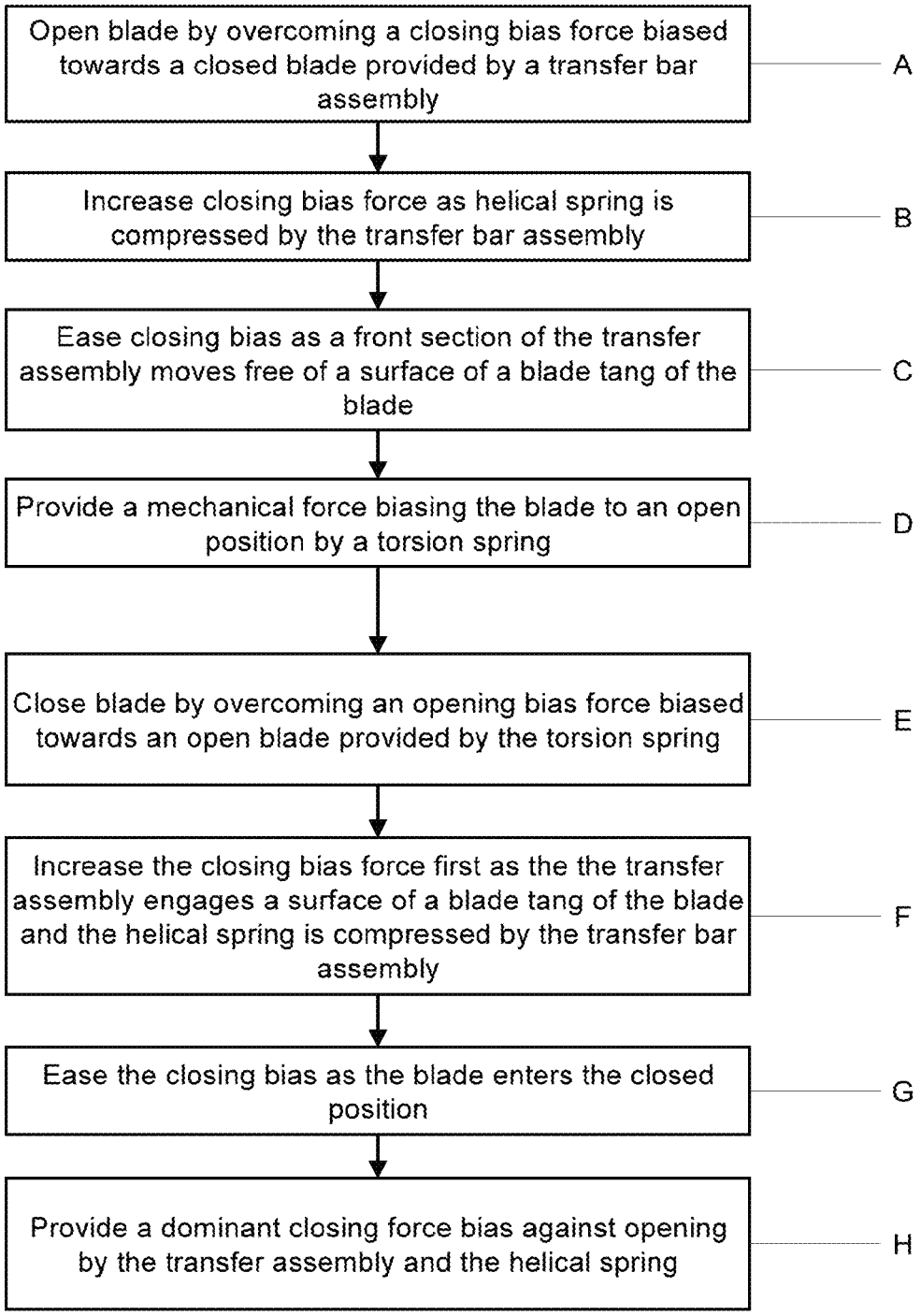
FIG. 12 shows a flow chart summary of the steps to operate the spring-assisted folding knife of FIG. 11A.

FIG. 12 shows a flow chart summary of the steps to operate one exemplary embodiment of the spring-assisted folding knife described herein. In summary, in one embodiment, a method of operating a spring assisted folding knife includes the steps of: opening a blade from a blade closed position of the spring assisted folding knife by A) overcoming a closing bias force biased towards a closed blade provided by a transfer bar assembly; B) As the blade is removed from a handle, the closing bias force first increases as a helical spring is compressed by the transfer bar assembly; C) then the closing bias eases as a front section of the transfer assembly moves free of a surface of a blade tang of the blade; and D) a mechanical force biasing the blade to an open position provided by a torsion spring becomes dominant, the torsion spring having been previously pre-tensioned in the blade closed position, and then reaching a blade open position. The steps of closing the blade to the blade closed position from the blade open position are performed by E) overcoming an opening bias force biased towards an open blade provided by the torsion spring; F) As the blade is moved towards the handle, the closing bias force first increases as the transfer assembly engages a surface of a blade tang of the blade and the helical spring is compressed by the transfer bar assembly; G) then the closing bias eases as the blade enters the closed position H) with a dominant closing force bias against opening provided by the transfer assembly and the helical spring, and then the blade reaches the blade closed position.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. A method of operating a spring assisted folding knife comprising the steps of:

providing a spring assisted folding knife comprising a handle, a blade, a transfer bar assembly contained in a transfer bar assembly recess, a helical spring, and a coiled torsion spring;

pivotally moving said blade to overcome a blade closed bias force provided by said helical spring pressing against said transfer bar assembly followed by a blade opened bias provided by said coiled torsion spring, or to overcome a blade opened bias provided by said coiled torsion spring followed by a blade closed bias force provided by said helical spring pressing against said transfer bar assembly; and wherein said step of pivotally moving said blade comprises opening said blade from a blade closed position of said spring assisted folding knife by overcoming a closing bias force biased towards a closed blade provided by said transfer bar assembly wherein as said blade is removed from said handle, said closing bias force first increases as said helical spring is compressed by said transfer bar assembly, then said closing bias eases as a front section of said transfer assembly rotates past a sear of a blade tang of said blade and a mechanical force biasing said blade to an open position provided by said torsion spring becomes dominant, said torsion spring having been previously pre-tensioned in said blade closed position, and then reaching a blade open position.

2. The method of claim 1, further comprising the step of compressing partially said helical spring on opening said blade from a closed position to an opening angle of less than about 10° by said blade tang causing said transfer bar assembly to move in a compression direction towards said helical spring.

3. The method of claim 1, further comprising the step of moving partially a longitudinal axis of said front section away from a longitudinal axis of a rear section of said transfer bar assembly on further opening said blade to an opening angle of less than about 30° by said blade tang and causing tensioning of a leaf spring and partially un-tensioning said coiled torsion spring.

4. The method of claim 1, further comprising the step of moving further a longitudinal axis of said front section away from a longitudinal axis of a rear section of said transfer bar assembly on opening said blade from said closed position to an opening angle of less than about 90° by said blade tang substantially releasing axial pressure by said helical spring on said rear section of said transfer bar assembly and causing further tensioning of a leaf spring and un-tensioning said coiled torsion spring.

5. The method of claim 1, further comprising the step of continuing to un-tension said coiled torsion spring as the blade moves further towards a blade fully opened position.

6. The method of claim 1, further comprising the step of stopping a stop surface of said blade tang against a spine stop in a blade fully opened position.

7. The method of claim 1, further comprising the step of locking said blade into an opened position by a liner lock moving behind a flat surface of said blade tang.

8. The method of claim 1 wherein said step of pivotally moving said blade comprises closing said blade to a blade closed position from a blade open position by overcoming an opening bias force provided by said torsion spring and wherein as said blade is moved towards said handle, a closing bias force first increases as a front section of said transfer assembly engages a sear of a blade tang of said blade and said helical spring is compressed by said transfer bar assembly, then eases as said blade enters said closed position with a dominant closing force bias against opening provided by said transfer assembly and said helical spring.

9. The method of claim 8, further comprising the step of un-locking said blade from an opened locked position by a depressing a liner lock moving the liner lock from behind a flat surface of said blade tang.

10. The method of claim 8, further comprising the step of moving a stop surface of said blade tang away from a spine stop as the blade rotates from a blade fully opened position.

11. The method of claim 8, further comprising the step of tensioning said coiled torsion spring as the blade moves further from a blade fully opened position.

12. The method of claim 8, further comprising the step of moving a longitudinal axis of said front section towards a longitudinal axis of a rear section of said transfer bar assembly on closing said blade from an opened position to a closing angle of less than about 90° by said blade tang substantially engaging an axial pressure on said helical spring on said rear section of said transfer bar assembly and causing an un-tensioning of a leaf spring and a tensioning said coiled torsion spring.

13. The method of claim 8, further comprising the step of moving partially a longitudinal axis of said front section towards a longitudinal axis of a rear section of said transfer bar assembly on further closing of said blade to a closing angle of less than about 30° by said blade tang and causing an un-tensioning of a leaf spring and further tensioning said coiled torsion spring.

14. The method of claim 8, further comprising the step of compressing said helical spring on closing said blade from a partially opened position to a closing angle of less than about 10° by said blade tang causing said transfer bar assembly to move in a compression direction towards said helical spring.

15. The method of claim 8, further comprising the step of closing said blade in said handle.

16. The method of claim 1, further comprising, after a blade opened position is reached, a step of locking said blade in an open position by engaging a liner lock against a rear flat vertical surface of a blade tang.

17. The method of claim 1, further comprising a step of grasping a thumb stud before said step of pivotally moving said blade.

18. A method of operating a spring assisted folding knife comprising the steps of:

providing a spring assisted folding knife comprising a handle, a blade, a transfer bar assembly contained in a transfer bar assembly recess, a helical spring, and a coiled torsion spring;

pivotally moving said blade to overcome a blade closed bias force provided by said helical spring pressing against said transfer bar assembly followed by a blade opened bias provided by said coiled torsion spring, or to overcome a blade opened bias provided by said coiled torsion spring followed by a blade closed bias force provided by said helical spring pressing against said transfer bar assembly; and wherein said step of pivotally moving said blade comprises closing said blade to a blade closed position from a blade open position by overcoming an opening bias force provided by said coiled torsion spring and wherein as said blade is moved towards said handle, a closing bias force first increases as a front section of said transfer bar assembly engages a sear of a blade tang of said blade and said helical spring is compressed by said transfer bar assembly, then eases as said blade enters said closed blade position with a dominant closing force bias against opening provided by said transfer bar assembly and said helical spring, and moving a longitudinal axis of said front section towards a longitudinal axis of a rear section of said transfer bar assembly on closing said blade from an opened position to a closing angle of less than about 90° by said blade tang substantially engaging an axial pressure on said helical spring on said rear section of said transfer bar assembly and causing an un-tensioning of a leaf spring and a tensioning said coiled torsion spring.

19. A method of operating a spring assisted folding knife comprising the steps of:

providing a spring assisted folding knife comprising a handle, a blade, a transfer bar assembly contained in a transfer bar assembly recess, a helical spring, and a coiled torsion spring;

pivotally moving said blade to overcome a blade closed bias force provided by said helical spring pressing against said transfer bar assembly followed by a blade opened bias provided by said coiled torsion spring, or to overcome a blade opened bias provided by said coiled torsion spring followed by a blade closed bias force provided by said helical spring pressing against said transfer bar assembly; and wherein said step of pivotally moving said blade comprises closing said blade to a blade closed position from a blade open position by overcoming an opening bias force provided by said coiled torsion spring and wherein as said blade is moved towards said handle, a closing bias force first increases as a front section of said transfer bar assembly engages a sear of a blade tang of said blade and said helical spring is compressed by said transfer bar assembly, then eases as said blade enters said closed blade position with a dominant closing force bias against opening provided by said transfer bar assembly and said helical spring, and moving partially a longitudinal axis of said front section towards a longitudinal axis of a rear section of said transfer bar assembly on further closing of said blade to a closing angle of less than about 30° by said blade tang and causing an un-tensioning of a leaf spring and further tensioning said coiled torsion spring.

* * * * *